US005246287A

United States Patent [19]

Isherwood et al.

[11] Patent Number: 5,246,287

[45] Date of Patent: Sep. 21, 1993

[54] COLLOIDAL GROUT MIXING APPARATUS AND METHOD

[75] Inventors: John Isherwood, Leigh; Gary Christian, Wirral; Timothy J. Wearden, St. Helens, all of United Kingdom

[73] Assignee: British Nuclear Fuels plc, Warrington, United Kingdom

[21] Appl. No.: 785,335

[22] Filed: Nov. 1, 1991

Related U.S. Application Data

[63] Continuation of Ser. No. 546,501, Apr. 11, 1990, abandoned, which is a continuation of Ser. No. 106,591, Oct. 13, 1987, abandoned.

[30] Foreign Application Priority Data

Oct. 28, 1986 [GB] United Kingdom ..... 8625715

[51] Int. Cl.[5] ..... B28C 7/04; B28C 5/16; B01F 15/02

[52] U.S. Cl. ..... 366/8; 366/15; 366/51; 366/65; 366/111; 366/136; 366/138; 366/141; 366/190

[58] Field of Search ..... 366/2, 6, 1, 8, 13, 366/15, 16, 18, 40, 42, 43, 51, 64, 65, 66, 108, 111, 136, 137, 138, 141, 142, 160, 190, 325

[56] References Cited

U.S. PATENT DOCUMENTS

| | | | |
|---|---|---|---|
| 2,387,488 | 10/1945 | Acken et al. | 366/325 X |
| 3,326,815 | 6/1967 | Werner et al. | 366/136 X |
| 3,966,175 | 6/1976 | Stock et al. | 366/141 |
| 3,977,655 | 8/1976 | Okabayashi et al. | 366/325 |
| 4,007,921 | 2/1977 | Zingg | 366/136 X |
| 4,212,547 | 7/1980 | Thomson | 366/141 |
| 4,225,247 | 9/1980 | Hodson | 366/40 |
| 4,257,710 | 3/1981 | Delcoigne et al. | 366/8 |
| 4,403,866 | 9/1983 | Falcoff et al. | 366/136 |
| 4,464,055 | 8/1984 | Mercatoris et al. | 366/40 |
| 4,552,463 | 11/1985 | Hodson . | |
| 4,568,196 | 2/1986 | Hacheney | 366/137 |
| 4,588,299 | 5/1986 | Brown et al. | 366/8 |
| 4,660,988 | 4/1987 | Hara et al. | 366/137 |
| 4,693,037 | 9/1987 | McNeil | 366/108 |

FOREIGN PATENT DOCUMENTS

| | | | |
|---|---|---|---|
| 232835 | 8/1987 | European Pat. Off. | 366/138 |
| 600277 | 3/1978 | U.S.S.R. | 366/111 |
| 1245335 | 7/1986 | U.S.S.R. | 366/65 |
| 942400 | 11/1963 | United Kingdom . | |
| 1598622 | 9/1981 | United Kingdom . | |

*Primary Examiner*—Harvey C. Hornsby
*Assistant Examiner*—Charles Cooley
*Attorney, Agent, or Firm*—William R. Hinds

[57] ABSTRACT

A mixing method uses, and a colloidal grout mixing apparatus comprises, an upright cylindrical vessel in which a mixer is located. The mixer comprises a shaft extending substantially co-axially with the longitudinal axis of the vessel, and a paddle assembly mounted on the shaft. The paddle assembly produces a vortex in liquid in the vessel, and also provides a high shear region near the base of the vessel. A non-shear pump is connected to the base to discharge grout from the vessel. The grout may be discharged to a drum containing radioactive waste and mounted on a vibratory platform.

16 Claims, 1 Drawing Sheet

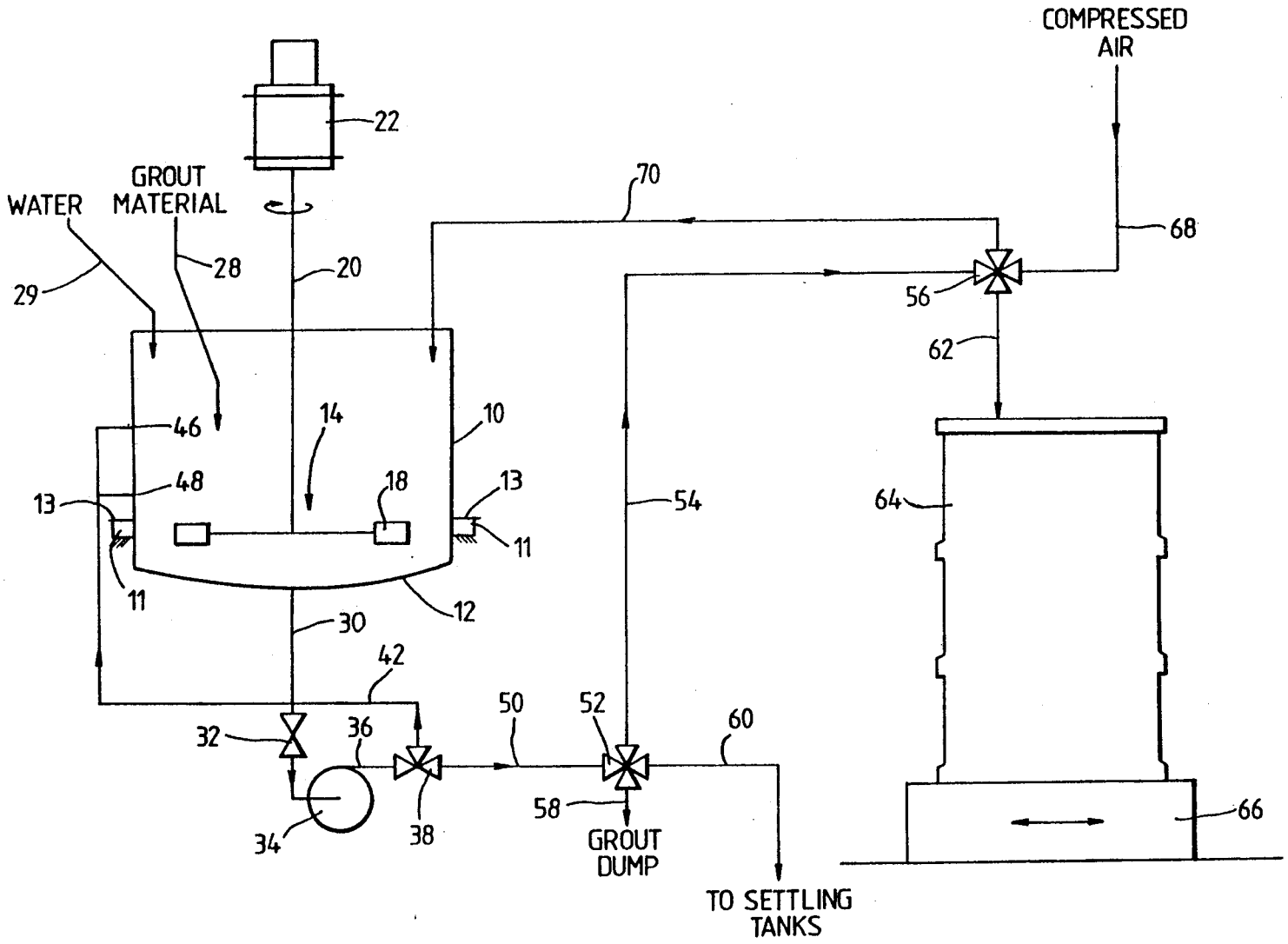
COMPRESSED AIR
68
56
62
64
66
70
54
60
TO SETTLING TANKS
52
GROUT DUMP
58
50
38
42
36
34
32
30
10
13
11
12
18
14
20
22
28
GROUT MATERIAL
46
48
WATER
29

COLLOIDAL GROUT MIXING APPARATUS AND METHOD

This is a continuation of application Ser. No. 546,501, now abandoned, filed Apr. 11, 1990, which is a continuation of Ser. No. 106,591 filed Oct. 13, 1987, now abandoned.

This invention relates to colloidal grout mixing and apparatus therefor, and more particularly but not exclusively, to a method and apparatus for mixing colloidal grouts in a system for immobilising solid radioactive waste.

The term "colloidal grout" is used herein to describe cementitious grouts prepared using colloidal type mixers. These grouts are not colloidal in the strict scientific sense although they undoubtedly contain some colloidal size material.

The properties which make colloidal grouts specially suited to high quality grouting applications (e.g. grouting of prestressed concrete members, and in the immobilisation of radioactive waste) are minimal bleed (i.e. water ejection from the grout), segregation and filtration (i.e. particles filtering out or depositing), and the ability to displace water. This ensures that good penetration of fine fissures is achieved, and that voids initially filled with cement grout remain fully grouted following hydration of the cement.

Many types of grout mixers are known, including paddle and colloidal mixers. Paddle mixers simply mix grout by means of a rotating paddle which throws the grout against baffles attached to the side of a mixing tank, and are usually used for grouts having water/cement ratios greater than 0.5. Colloidal mixers provide a grout of higher quality, and work by subjecting cement particles in water to a high shearing action, thus removing any air attached to the particles and ensuring thorough wetting of the particles. The shearing force in such colloidal mixers is sometimes supplied by rotating rollers, but usually by an impeller which rotates at high speed.

The above known colloidal grout mixers have a number of drawbacks. Firstly, most are usually only capable of mixing relatively small quantities of grout and those of higher capacity require a high energy input. This leads to an unacceptable temperature rise (e.g. above 30° C.) during mixing of the grout and can lead to the formation of microcracks in the grout when fully hydrated. Also, the high shear action of the mixer, means that a second tank is needed for grout hold-up prior to distribution by a non-shear pump, since pumping from the mixer would produce excessive additional shear and so adversely affect the grout properties.

The present invention, therefore, in one aspect provides a method of mixing a colloidal grout, the method comprising, feeding a measured quantity of water into a cylindrical vessel, rotating a paddle means having a plurality of paddle members at a relatively high speed in the vessel, the paddle members being positioned relative to the base of the vessel and having a shape and a dimension relative to the internal radius of the vessel such as to produce a high shear region near the base and a vortex in the water, and feeding a measured quantity of grout materials downwardly into the vortex so as to mix the grout materials and thereby produce a colloidal grout.

Preferably, the paddle means is subsequently rotated at a relatively low speed so as to maintain the colloidal grout mobile in the vessel.

According to another aspect of the invention, a colloidal grout mixing apparatus comprises a cylindrical mixing vessel, an outlet port at or near the base of the vessel, a non-shear pump means for discharging mixed grout from the outlet port, and a mixing means having two speeds and extending into the vessel, the mixing means including a shaft aligned substantially co-axially with the longitudinal axis of the vessel and a paddle means mounted on the shaft, the paddle means comprising a plurality of paddle members each having a shape adapted to cause substantial outward radial displacement therefrom as the shaft rotates, each paddle member being positioned at substantially the same distance above the base of the vessel and having a radial dimension relative to the internal radius of the vessel such that in operation at the faster of the two speeds, the paddle means produces a vortex in liquid in the vessel and a high shear region near the base, and at the lower of the two speeds maintains a colloidal grout in the vessel mobile.

Preferably, the base is of dished form, and the paddle means is located relative to the base such as to provide a region of substantially uniform swirling near the base.

A recirculation circuit may be provided between the pump means and the vessel, for the recirculation of grout materials/water mixture discharged from the vessel. The invention further includes a system for immobilising radioactive waste, comprising a colloidal grout mixing apparatus in accordance with the invention, a vibratory platform for supporting a container for radioactive waste, and a discharge duct adapted to connect between the pump means and the container. Preferably, the system includes a pressurised gas source connectable to the discharge duct.

The invention will now be further described by way of example only with reference to the Figure in the accompanying drawing, which shows a side diagrammatic representation of a system for immobilising radioactive waste and incorporating a grout mixing apparatus of the invention.

Referring to the Figure, a cylindrical vessel 10 is shown with a dished base 12, and is supported through load cells 11 from radial projections 13. A top entry mixer 14 extends into the vessel 10 and has a paddle mixer 18 mounted on a shaft 20 aligned substantially coaxially with the longitudinal axis of the vessel 10 and arranged to be driven by a two-speed electric motor 22. The paddle mixer 18 is located near the base 12, and is adapted to produce a high shear region thereat when the motor 22 is at the higher speed. The radial dimensions of the paddle mixer 18 are such as to produce a vortex in liquid (not shown) in the vessel 10 at this higher speed. Inlets 28, 29 for grout materials and water respectively are located above the vessel 10, and a discharge duct 30 from the base 12 connects through a shut-off valve 32 to a non-shear pump 34 such as a peristaltic pump or a Mono pump which discharges through a duct 36 to a two-way valve 38. A duct 42 from the valve 38 is connected to the side of the vessel 10 at two vertically displaced, injection ports 46, 48 respectively. A duct 50 from the valve 38 connects with a three-way valve 52 having one duct 54 connected to a three-way valve 56, another duct 58 leading to a grout dump (not shown), and a third duct 60 connected to settling tanks (not shown). The valve 56 has a duct 62 which leads to a drum 64 containing radioactive waste (not shown) and mounted on a vibratory platform 66. A compressed air duct 68 discharges into the valve 56, and a return duct 70 extends from the valve 56 to the vessel 10.

In operation, using the load cells 11 to monitor the required weights, firstly water is fed through the duct 29, then the motor 22 is operated at its higher speed, so that a vortex is produced in the water by the rotation of the paddle mixer 18. Pre-mixed grout materials are fed through the duct 28 into the vortex and the high shear region produced by the paddle mixer 18 so that the grout materials are thoroughly wetted. When mixing of the grout materials and water has formed a colloidal grout, the motor 22 is run at its lower speed to keep the colloidal grout mobile without any additional shearing action on the colloidal grout. In order to optimise the mixing regime in the vessel 10, the grout materials and water may be recirculated through the duct 30, and the duct 42, and injected through the ports 46, 48 into the vessel 10 until mixing is complete.

When the colloidal grout is required, the valve 32 is opened and the pump 34 discharges the grout through the duct 54, the valve 56 and the duct 62 to the drum 64, the amount of grout discharged being monitored by the load cells 11 and excess grout being returned to the vessel 10 by the duct 70. The drum 64 is vibrated by the platform 66 to assist infilling of the colloidal grout into the fissures and crevices of the radioactive waste in the drum 64, and compressed air through the ducts 68, 62 aids injection of the grout into the drum 64.

An internal spray ring (not shown) is fitted inside the vessel 10 to wash down the interior of the vessel 10, the valve 52 being selected to dump either surplus colloidal grout from the vessel 10 through the duct 58, or washdown liquid from the vessel 10 through the duct 60 to the settling tanks. The vessel 10 is desirably constructed from stainless steel to assist washdown. Use of the dished base 12 is advantageous in that it results in fairly uniform swirling near the base 12. Instead of discharging through the parts 46, 48, the duct 42 may extend (not shown) above the vessel 10 and discharge downwardly into the vessel 10 at a position displaced from and on the opposite side of the shaft 20 to the duct 28.

It has been found that with a paddle mixer 18 having a diameter D and a vessel 10 having an internal diameter T, optimum performance of the apparatus has been obtained when D/T=7/16. When D=35 cm, optimum height of the paddle mixer 18 is between 30–43 cm above the base of the vessel 10, preferably about 35 cm.

A suitable paddle mixer, for example Model R100, obtained from Lightnin Mixers Ltd, Poynton, Cheshire, England, or Mixing Equipment Co, Rochester, N.Y. 14603, USA, may be operated at from 380 to 466 rpm for mixing and about 180–210 rpm for maintaining the colloidal grout mobile. Such a paddle mixer has flat paddles aligned in longitudinal axial planes with respect to the shaft 20 and located all at the same height above the base of the vessel 10.

The grout mixing apparatus of the invention has been used to produce colloidal grouts which remain workable for up to 2½ hours.

Suitable grout materials for the immobilisation of radioactive waste might have a grout base of ground blast furnace slag (BFS)/ordinary Portland cement (OPC), in a proportion of 70–90% BFS by weight but a ratio 75 BFS/25 OPC by weight is preferred. A water/solid ratio of between 0.31 to 0.35 by weight is desirable, preferably 0.33±0.02. For a water/solid ratio of 0.33, chilled water at about 8° C. should be used to prevent excessive temperature rise of the grout as it is kept mobile for up to 2½ hours. A lower water/solid ratio of 0.31 would require the use of chilled water at about 5° C. to prevent excessive temperature rise. An acceptable maximum temperature of the grout is about 30° C. When the grout is to be used soon after it has been mixed, the use of chilled water should not be necessary. Conventional equipment (not shown) may be used to produce the chilled water required.

Pulverised fuel ash (PFA) and OPC is another cementitious mixture that might be used, particularly for immobilising plutonium contaminated waste materials when proportions of between 70% and 80% PFA with a water to solids ratio of 0.41 to 0.50 might be used. A preferred OPC should have relatively low $(CaO)_3 SiO_2$ balanced by $SiO_2$ to reduce the energy of the reaction between the OPC and water.

For grouts used in immobilising radioactive waste:

(i) the OPC should comply with British Standard 12:1978 which is incorporated by reference herein and preferably with further compliance with the following limits:

| | weight % |
|---|---|
| tricalcium silicate | 48–55 |
| dicalcium silicate | 12–24 |
| tricalcium aluminate | 9–11 |
| tetracalcium aluminoferrite | 5–11 |
| $Na_2O$ equivalent = $Na_2O$ + 0.658 $K_2O$ = max 0.8% by weight | |
| Chloride (water soluble) = max 30 ppm | |
| Surface area = 350 ± 30 sq meters/kg | |

(ii) The BFS should comply with the draft British Standard BS6699 which is incorporated by reference herein, and preferably with further compliance with the following limits:

| | weight % |
|---|---|
| $Fe_2O_3$ = | 0.80% max |
| $Al_2O_3$ = | 15 max |
| $Na_2O$ = | 0.6 max |
| $K_2O$ = | 1.0 max |
| Chloride (water soluble) = | 30 ppm max |
| Surface area - 340 ± 30 sq meters/kg | |
| Density = 2.90–2.95 g/cm$^3$ | |

(iii) The PFA should comply with BS 3892 Part 1:1982 which is incorporated by reference herein and preferably with further compliance with the following limits:

| | weight % |
|---|---|
| $Na_2O$ equivalent (water soluble) = | 0.20 max |
| Chloride (water soluble) = | 0.003 max |
| Colour index = | 7 max |
| Density = | 2.0 g/cm$^3$ min |

Although the invention has been described in relation to mixing a colloidal grout for use in immobilising radioactive waste, grouts produced by the invention might also have applications in the civil engineering and construction industries.

We claim:

1. A method of mixing a colloidal grout having a water/solids ratio of 0.5 by weight or less, the method comprising feeding a measured quantity of water into a cylindrical vessel having a base, rotating in the vessel, a paddle means having a shaft aligned substantially coaxially with the longitudinal axis of the vessel and having a plurality of paddle members and a paddle diameter of 35 cm at a relatively fast rotational rate between 380 rpm and 466 rpm, positioning the paddle members between 30 cm and 43 cm above the base of the vessel and the paddle members having a radial dimension relative to the internal radius of the vessel in the ratio of about 7:16 such as to produce a high shear region near the base and a vortex in the water, feeding a measured quantity of grout materials downwardly into the vortex so as to mix the grout materials and the water with a water/solids ratio of 0.5 by weight or less and thereby produce the said colloidal grout, and discharging mixed grout from an outlet port at least near the base of the vessel via non-shear pump means.

2. A method as claimed in claim 1, including subsequently rotating the paddle means at a relatively low speed relative to said relatively fast speed so as to maintain the colloidal group mobile in the vessel.

3. A method as claimed in claim 2, wherein the grout materials comprise a mixture comprising 70% to 90% by weight ground blast furnace slag and ordinary Portland cement, and the measured quantities are such as to produce a water/solids ratio of between 0.31 to 0.35 by weight.

4. A method as claimed in claim 3, wherein the mixture comprises 75% by weight of ground blast furnace slag.

5. A method as claimed in claim 4, wherein the water/solids ratio is 0.33±0.02 by weight.

6. A method as claimed in claim 3, wherein the cement comprises:

| | |
|---|---|
| tricalcium silicate | 48-55% by weight |
| dicalcium silicate | 12-24% by weight |
| tricalcium aluminate | 9-11% by weight |
| tetracalcium aluminoferrite | 5-11% by weight |

7. A method as claimed in claim 3, wherein the blast furnace slag comprises:

| | |
|---|---|
| $Fe_2O_3$ = | 0.80% max by weight |
| $Al_2O_3$ = | 15 max by weight |
| $Na_2O$ = | 0.6 max by weight |
| $K_2O$ = | 1.0 max by weight |

8. A method as claimed in claim 2 wherein the grout materials comprise a mixture comprising 70 to 80% by weight pulverised fuel ash and ordinary Portland cement, and the measured quantities are such that a colloidal grout is produced having a water/ solids ratio of between 0.41 to 0.50 by weight.

9. A colloidal grout mixing apparatus comprising a cylindrical mixing vessel having a base, an outlet port at least near the base of the vessel, and a non-shear pump means for discharging mixed grout from the outlet port, wherein the improvement comprises a mixing means having two speeds and extending into the vessel, the upper speed being between 380 rpm and 466 rpm, the mixing means including a shaft aligned substantially coaxially with the longitudinal axis of the vessel and a paddle means mounted on the shaft, the paddle means comprising a plurality of paddle members arranged to provide a paddle diameter of 35 cm and each having a shape adapted to cause substantial outward radial displacement therefrom of material being mixed as the shaft rotates, each paddle member being positioned at a height between 30 cm and 43 cm above the base of the vessel and having a radial dimension relative to the internal radius of the vessel in the ratio of about 7:16 such that in operation, at the faster of the two speeds with the paddle means rotating at a rate between 380 rpm and 466 rpm the paddle means produces a vortex in liquid in the vessel and a high shear region near the base, and at the lower of the two speeds maintains a colloidal grout in the vessel mobile.

10. An apparatus as claimed in claim 9, wherein the diameter of the paddle members is substantially the same as the height of the paddle members above the base.

11. An apparatus as claimed in claim 9, wherein the paddle members are of flat form and lie in respective longitudinal axial planes with respect to the shaft.

12. An apparatus as claimed in claim 11, wherein load cells support the vessel so as to monitor the weight of material fed into and discharged from the vessel.

13. An apparatus as claimed in claim 9 wherein a recirculation circuit is provided between the pump means the vessel, for the recirculation of grout materials and water which are discharged from the vessel.

14. An apparatus as claimed in claim 9, including a vibratory platform for supporting a container, and a discharge duct adapted to connect between the pump means and the container for infilling the container with colloidal grout from the vessel.

15. An apparatus as claimed in claim 14, wherein a valve means is included in the discharge duct, and a return duct connects between the valve means and the mixing vessel, and the valve is controllably arranged to direct discharge of the colloidal grout either to the container or back to the vessel.

16. A colloidal grout mixing apparatus comprising, a cylindrical vessel having a base and having an internal diameter of about 80 cm, an outlet port at least near the base of the vessel, a non-shear pump means connected to the outlet port for discharging mixed grout from the vessel, a shaft aligned substantially coaxially with the longitudinal axis of the vessel, a motor at one end of the shaft and having two speeds, the higher of the two speeds being between 380 and 466 rpm and the lower speed being between 180 and 210 rpm, and a paddle mixer at the other end of the shaft located about 35 cm above the base of the vessel, the paddle mixer having a diameter of about 35 cm and a plurality of flat paddle members which lie in respective longitudinal axial planes with respect to the shaft, load cells adapted to support the vessel so as to monitor the weight of material fed into and discharged from the vessel, a recirculation circuit connected between the pump means and the side of the vessel, a vibratory platform for supporting a container, a valve means, a discharge duct from the pump means and connected to the valve means, and return duct connected at one end to the valve means and at the other end being positioned above the vessel so as to discharge therein, an outlet duct from the valve means extending so as to discharge into the container, and the valve means being controllable so as to discharge grout from the vessel either to the container or back to the vessel.

* * * * *